US009460885B2

(12) United States Patent
Richardson et al.

(10) Patent No.: US 9,460,885 B2
(45) Date of Patent: Oct. 4, 2016

(54) MAGNETRON FILTER

(75) Inventors: Robert X. Richardson, Chelmsford (GB); Karl Osbourne, Colchester (GB)

(73) Assignee: E2V TECHNOLOGIES (UK) LIMITED, Chelmsford, Essex (GB)

( * ) Notice: Subject to any disclaimer, the term of this patent is extended or adjusted under 35 U.S.C. 154(b) by 0 days.

(21) Appl. No.: 14/124,464

(22) PCT Filed: May 31, 2012

(86) PCT No.: PCT/GB2012/051220

§ 371 (c)(1),
(2), (4) Date: Mar. 27, 2014

(87) PCT Pub. No.: WO2012/168695

PCT Pub. Date: Dec. 13, 2012

(65) Prior Publication Data

US 2014/0306604 A1 Oct. 16, 2014

(30) Foreign Application Priority Data

Jun. 6, 2011 (GB) ..... 1109441.4

(51) Int. Cl.
*H01J 23/15* (2006.01)
*H05B 6/66* (2006.01)

(52) U.S. Cl.
CPC ..... *H01J 23/15* (2013.01); *H05B 6/66* (2013.01)

(58) Field of Classification Search
USPC ..... 315/39.51, 39.53, 39.63, 500, 502, 503, 315/504; 219/687, 760, 678, 702
See application file for complete search history.

(56) References Cited

U.S. PATENT DOCUMENTS 4,900,985 A 2/1990 Tashiro et al.
5,604,405 A 2/1997 Ogura

FOREIGN PATENT DOCUMENTS

EP 0477633 A1 4/1992
EP 0493604 A1 7/1992
GB 2315654 A 2/1998
WO WO-2011058361 A1 5/2011

OTHER PUBLICATIONS

International Search Report of PCT/GB2012/051220 Dated Aug. 23, 2012.

*Primary Examiner* — Thai Pham
(74) *Attorney, Agent, or Firm* — FisherBroyles, LLP; Robert Kinberg

(57) ABSTRACT

A low-filter is arranged for attachment to an exterior face of a wall of an electrically conducting screened chamber encasing the magnetron and an associated isolation transformer electrically connected to terminals of the magnetron. Output connections of the filter pass directly through an interface between the electrically conducting screened chamber and the filter to connect electrically, directly or indirectly, with the isolation transformer. There are therefore no electrical leads outside the screened chamber electrically connecting the filter to the isolation transformer.

13 Claims, 4 Drawing Sheets

MAGNETRON FILTER

This invention relates to a filter for reducing stray emissions from a magnetron operating at frequencies in the vicinity of 900 MHz, and particularly in a range 890 to 930 MHz and to a method of filtering such stray emissions.

BACKGROUND

Magnetrons for known domestic ovens are provided with an L-C filter to prevent, as far as is possible, stray radiation generated by the magnetron from passing along the leads which supply power to the cathode heater. Such a filter, which is located at least partially within a screen chamber housing the magnetron terminals, is known from U.S. Pat. No. 4,900,985.

A typical domestic cooker magnetron has a peak power of a few kilowatts, and an average power of around 1 kW and requires a heater current of around 10 A. However, for industrial RF processing applications, peak powers of several tens of kilowatts are needed, and a correspondingly larger heater supply is needed with typical currents of the order of 100 amps, so that much higher gauge conductors are needed compared with domestic cooker magnetrons. In particular, it would not be practical or economic to wind such high gauge conductors into a choke coil used for a domestic cooker magnetron.

A basic problem to be addressed is therefore that in a microwave source for industrial applications a magnetron requires a high voltage supply to be applied to the cathode, perhaps as much as −20 kV, together with a heater supply of typically 11 V at 110 A, derived from an isolation transformer (and rectifier if a DC heater is used) connected across heater and cathode terminals of the magnetron. These terminals can be the source of considerable stray radiation in the frequency range 100 MHz to >1 GHz, as illustrated in a first inset 20 in FIG. 1, for a magnetron designed to produce an output at around 900 MHz. This stray radiation can be picked up and/or conducted in lead wires from the magnetron to the isolation transformer and lead wires from the isolation transformer to an external heater supply inverter. The isolation transformer, which is designed to hold off 20 kV, provides no significant barrier to currents induced by the stray radiation.

Because of the high levels of stray radiation, it is usually necessary fully to shield the magnetron and the isolation transformer in a metallic or other electrically conductive screened chamber. If a filter is fitted, its effectiveness may be limited by radiation picked up on its output. Such a filter may provide no attenuation to the stray radiation because the filter itself acts as an antenna and picks up the stray radiation on its output even although the filter may have significant attenuation over the desired frequency band.

In many applications the drive current from the heater supply inverter is modulated as a high frequency (Fi) square wave, as illustrated in a second insert 21 in FIG. 1. Any filter used must be able to pass, without any significant distortion and loss, the heater supply inverter waveform into the screened chamber but significantly attenuate and minimise stray radiation to the outside of the screened chamber.

It is an objective of the current invention at least to ameliorate some of these difficulties in the prior art.

BRIEF SUMMARY OF THE DISCLOSURE

In accordance with a first aspect of the present invention there is provided a low-pass filter for reducing stray emissions from a magnetron, wherein the filter is arranged for attachment to an exterior face of a wall of electrically conducting screening means for encasing the magnetron and for encasing an associated isolation transformer means electrically connected to terminals of the magnetron; and wherein an output connection of the filter passes directly through an interface between the electrically conducting screening means and the filter to connect electrically, directly or indirectly, with the isolation transformer.

Conveniently, the filter comprises a printed circuit board with a ground plane on a first face and at least one capacitor plate on a second face opposed to the ground plane on the first face, wherein the output connection of the filter is connected directly or indirectly to the capacitor plate.

Advantageously, the output connection is via a through-hole in the printed circuit board directly to the at least one capacitor plate.

Advantageously, an aperture is provided in the ground plane for passage therethrough of the output connection, for voltage hold off between the output connection and the ground plane.

Conveniently, the filter comprises a plurality of LC stages between a first line and a ground plane and between a second line and the ground plane.

Advantageously, inductors in neighbouring stages are orthogonal to each other to minimize coupling between the inductors.

Advantageously, capacitor plates of the plurality of LC stages have dimensions of substantially 22 mm by 22 mm.

Conveniently, the filter further comprises a first capacitor and a first resistor in series between the first line and the ground plane and a second capacitor and a second resistor connected in series between the second line and the ground plane to ensure a nominally matched impedance at frequencies of the stray radiation thereby minimizing gain of the filter at frequencies in the desired attenuation band but providing insignificant impedance to a waveform output from the heater supply inverter.

Advantageously, the filter further comprises filter electrical screening means encasing the filter and arranged for electrical connection to the electrically conducting screening means of the magnetron.

Conveniently, the ground plane is electrically connected to the filter electrical screening means.

Advantageously, the filter is arranged to filter stray radiation with frequencies in a range 100 MHz to 1 GHz.

Alternatively, the filter is arranged to filter stray radiation with frequencies in a range 100 MHz to 2 GHz.

Conveniently, the filter is arranged to filter stray radiation from a magnetron producing at output at a frequency of substantially 900 MHz.

According to a second aspect of the invention, there is provided a method for reducing stray emissions from a magnetron, using a low-pass filter attached to an exterior face of a wall of electrically conducting screening means encasing the magnetron and encasing an associated isolation transformer means electrically connected to terminals of the magnetron; wherein an output connection of the filter passes directly through an interface between the electrically conducting screening means and the filter to connect electrically, directly or indirectly, with the isolation transformer.

BRIEF DESCRIPTION OF THE DRAWINGS

Embodiments of the invention are further described hereinafter with reference to the accompanying drawings, in which.

DETAILED DESCRIPTION

Figure 1:
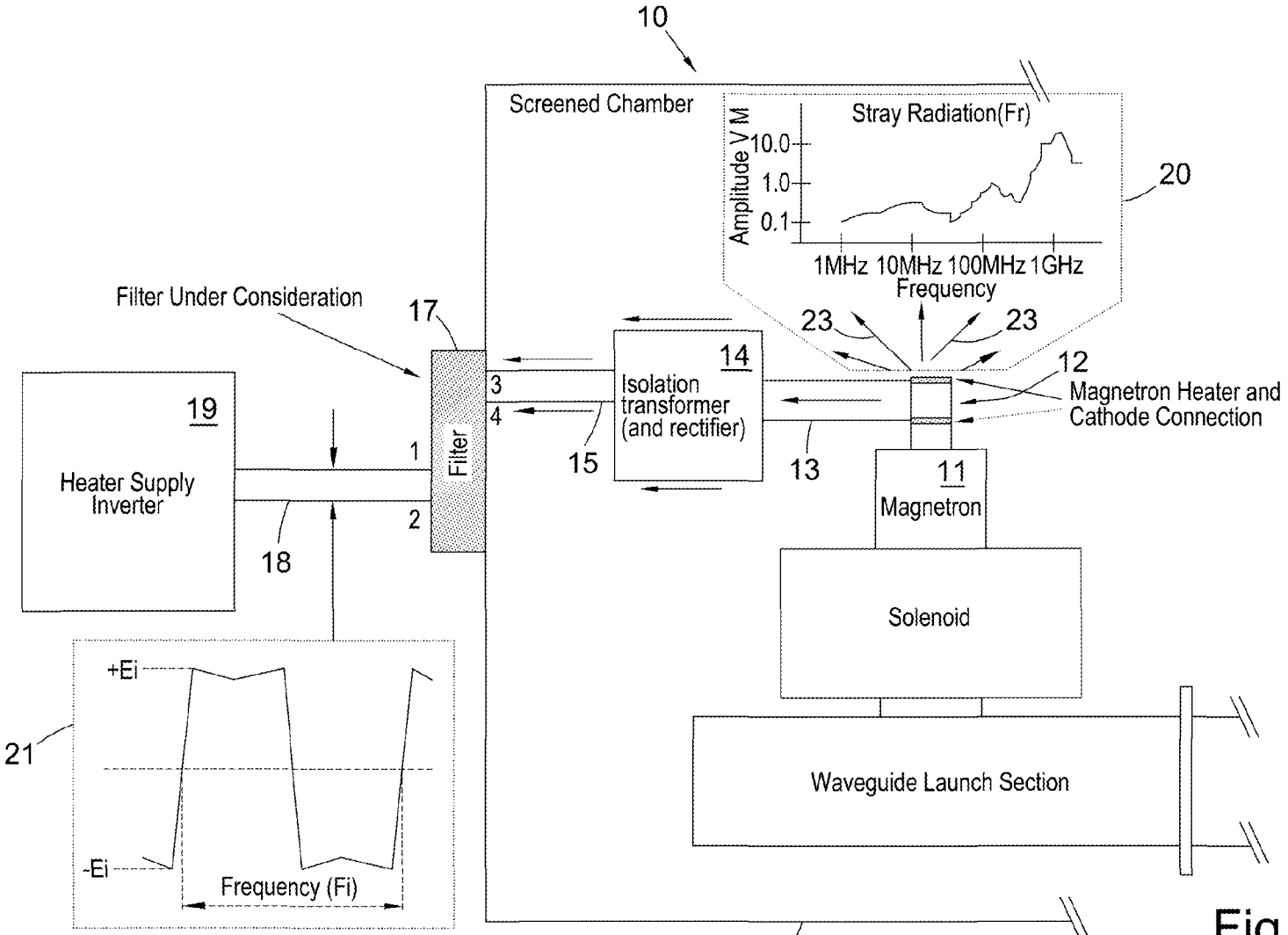
FIG. 1 is a schematic drawing of a magnetron and heater supply for use with the invention.

Referring to FIG. 1, a microwave radiation source 10, suitable for use with the invention, comprises a magnetron 11 with associated solenoid and waveguide launch section as shown, located in an electrically screened chamber 16. Also within the screened chamber 16 is an isolation transformer 14 connected to heater and cathode connections 12 of the magnetron 11 by output leads 13. Inputs of the isolation transformer are connected by input leads 15 to outputs 3, 4 of a filter 17 located externally on a wall of the screened chamber 16. Inputs 1, 2 of the filter 17 are connected by leads 18 to outputs of a heater supply inverter 19 external of the screened chamber 16. Locating the filter 17 outside the screened chamber 16 has the advantage of screening the filter components from the stray radiation 23 within the screened chamber 16.

Figure 2:
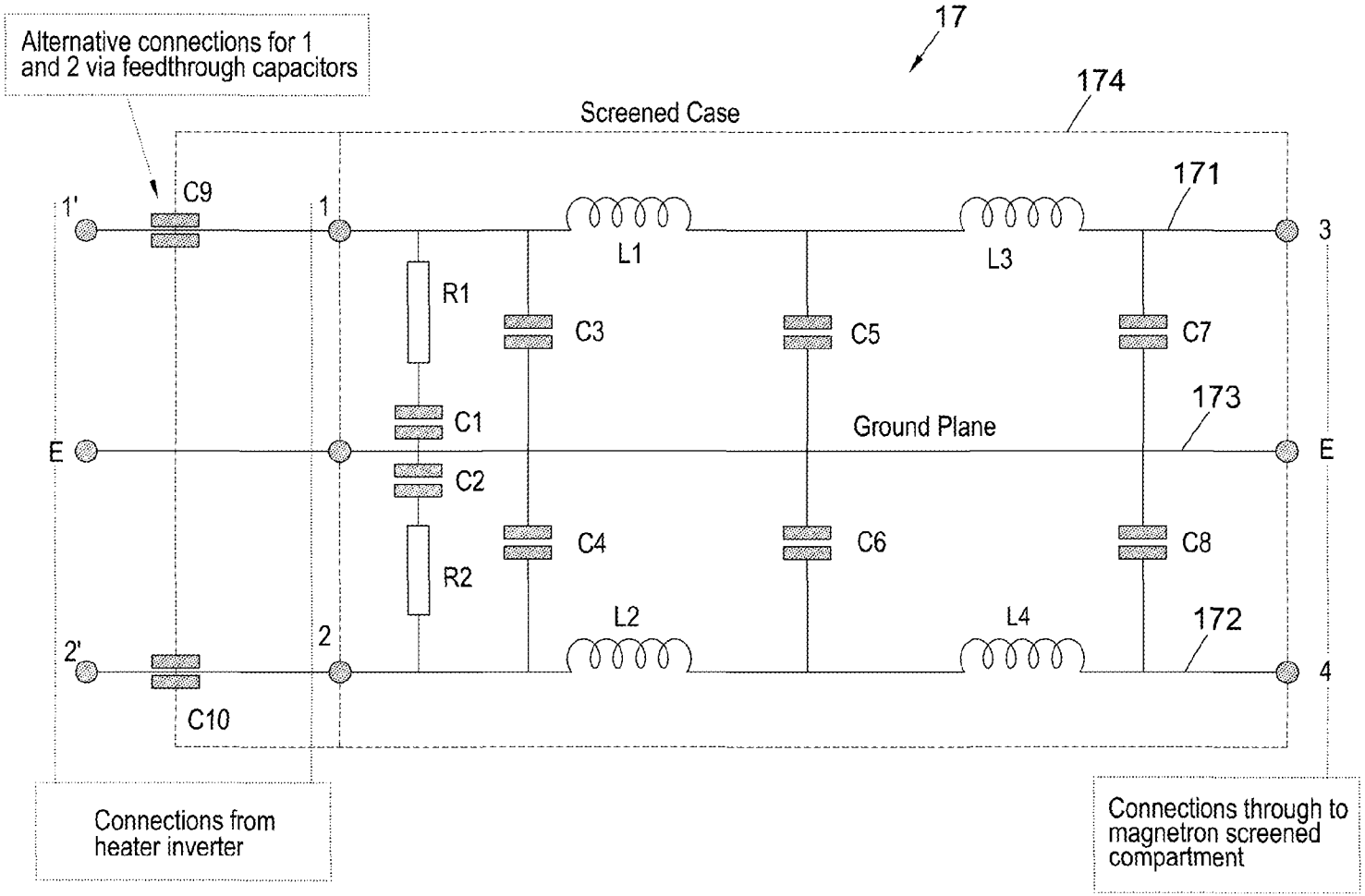
FIG. 2 is a circuit diagram of a filter according to the invention.
Figure 3:
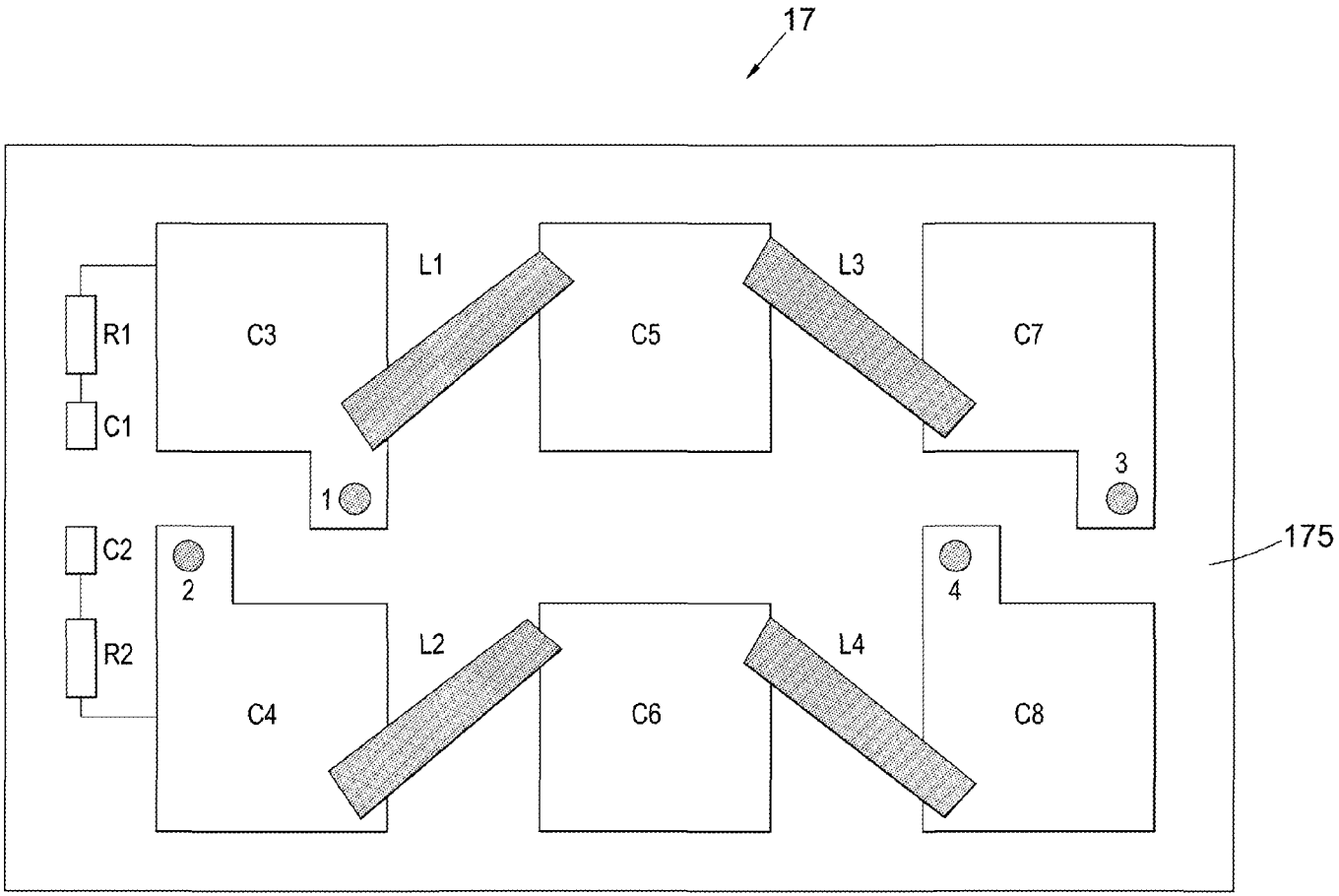
FIG. 3 is a schematic layout of the filter of FIG. 2.

A circuit diagram of an embodiment of the filter 17 according to the invention is shown in FIG. 2, with a schematic layout of the filter shown in FIG. 3. There is provided a simple low cost PCB based filter 17 according to the invention to reduce conducted emissions from a screened chamber 16 screening a magnetron 11. The filter 17 causes no significant distortion to a 600 V peak (1200 V peak to peak) 15 kHz trapezoidal waveform, illustrated in insert 21 in FIG. 1, that is used to provide drive to, and monitor, the current and voltage of an isolation transformer 14 mounted in the screened chamber 16. Loss due to a primary current of 6 A rms at 15 kHz is similarly kept low, less than 2 W being desirable.

Referring to FIG. 2, the circuit comprises a first line 171 between a first input connection 1 and a first output connection 3; a second line 172, parallel to the first line, between a second input connection 2 and a second output connection 4; and an earth plane 173 between the first line 171 and the second line 172.

The first line 171 comprises a first inductor L1 and a third inductor L3 connected in series. A first resistor R1 and a first capacitor C1 are connected in series between the first line 171 and the ground plane 173 at a point between the first input connection 1 and the first inductor L1. A third capacitor C3 is also connected between the first line 171 and the ground plane 173 at a point between the first resistor R1 with the first capacitor C1 in series and the first inductor L1. A fifth capacitor C5 is connected between the first line 171 and the ground plane 173 at a point between the first inductor L1 and the third inductor L3. A seventh capacitor C7 is connected between the first line 171 and the ground plane 173 at a point between the third inductor L3 and the first output connection 3.

The second line 172 comprises a second inductor L2 and a fourth inductor L4 connected in series. A second resistor R2 and a second capacitor C2 are connected in series between the second line 172 and the ground plane 173 at a point between the second input connection 2 and the second inductor L2. A fourth capacitor C4 is also connected between the second line 172 and the ground plane 173 at a point between the second resistor R2 with the second capacitor C2 in series and the second inductor L2. A sixth capacitor C6 is connected between the second line 172 and the ground plane 173 at a point between the second inductor L2 and the fourth inductor L4. An eighth capacitor C8 is connected between the second line 172 and the ground plane 173 at a point between the fourth inductor L4 and the second output connection 4.

Figure 4:
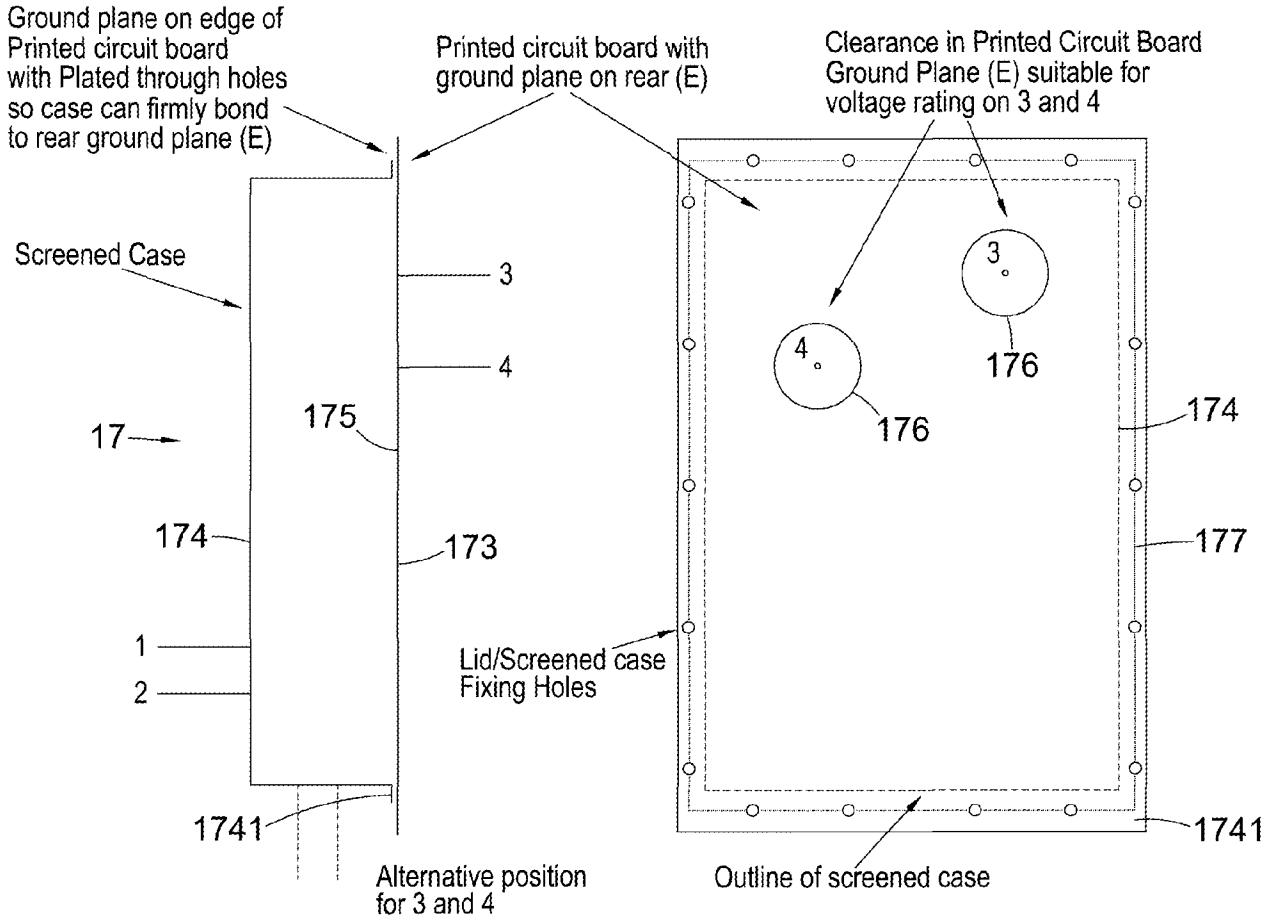
FIG. 4 is a schematic side view and a base view of the case and connections of the filter of FIG. 2.

With a suitable choice of component values, at 900 MHz the filter attenuation is around 55 dB or better. Roll off starts at 120 MHz at 3 dB attenuation, that is there is 3 dB attenuation at 120 MHz rising to substantially 55 dB attenuation at 900 MHz. This filter performance is provided for each line of the line drive 18 from the heater supply inverter 19 and filters a noise voltage on each line 18 with respect to earth. For the filter to be effective the third to eighth capacitors C3 to C8 have very low inductance and the connections 3 and 4 to the seventh and eight capacitors C7 and C8 are directly to the capacitor plates without any leads, as best seen in FIGS. 3 and 4. That is, by using a PCB capacitor, the connections are directly to the plates of the capacitors via feedthrough connections 3 and 4 through the printed circuit board. As shown in FIG. 3, the first and second input connections 1 and 2 are similarly directly connected to plates of the third and fourth capacitors, C3 and C4, respectively. Although in the presently preferred embodiment the connections 3 and 4 are connected by through holes directly to the capacitor plates, it will be understood that alternatively the through holes may be connected to conductors on the printed circuit board which are connected to the capacitor plates. Moreover, it will be understood that in an alternative arrangement, direct connection to capacitors could be made without the use of a printed circuit board. Moreover, although the isolation transformer is shown in FIG. 1 connected by input leads 15 to the filter 17 mounted on an external face of the wall of the screened chamber 16, it will be understood that the isolation transformer may alternatively be mounted on an inner face of the screened chamber 16 opposed to the external face on which the filter is mounted, so that the filter may be directly electrically connected to the isolation transformer without a requirement for the input leads 15.

The filter is based upon a double-sided 1.0 mm thick FR4 board 175 with one side a ground plane 173 with all components surface mounted on the upper face opposed to the ground plane. A soldered case 174 bonded to the ground plane 173 provides full screening to the filter unit 17.

Also shown in FIG. 2 is an alternative arrangement of the input connections 1' and 2' which includes additional feedthrough capacitances C9 and C10 respectively in the walls of the screened case 174 if additional attenuation is required.

As best seen in FIG. 3, the size of the printed circuit board 175 for the filter 17 is determined primarily by the size of the third to eighth capacitors C3 to C8. These capacitors each comprise, for example, a 22 mm by 22 mm square with a 5 mm gap between each capacitor and between the capacitors and side walls of the screened case 174.

Each inductor L1 to L4 comprises, for example, six equally spaced turns of 1.0 mm tinned copper wire, wound on a 13 mm long 10 mm diameter former. Tinned copper is preferred to enamelled copper because of the greater loss of enamelled wire when the majority of the current is subject to the skin effect at high frequencies. As shown in FIG. 3, coils of the first and second inductors L1 and L2 are mounted at right angles to the coils of the third and fourth inductors L3 and L4, to minimize coupling. This ensures that the required attenuation is achieved without a need for internal screening that would otherwise increase cost and mechanical complexity.

The first and second resistors R1, R2, (e.g. 100 ohm 0.5 W carbon) and first and second capacitors C1, C2 (e.g. 150 pF 1 kV NPO SM (i.e. surface mounted) ceramic) ensure the filter does not have any passband gain by providing low frequency damping and matching. It will be understood that NPO ceramic is a class of ceramic dielectric that is stable over a wide temperature and voltage range. These component values are required because the source and load impedances of the filter are unknown when the components are optimised for their primary filtering purpose. This usually gives undefined impedance at a frequency of the stray radiation 23. Values of capacitance and resistance respectively of the first and second capacitors C1 and C2 connected in series with the matching first and second resistors R1 and R2 are chosen to ensure a low reactance at the stray radiation frequencies but to provide insignificant impedance to the waveform output from the heater supply inverter 16.

As best shown in FIG. 4, filter input connections 1 and 2 pass through the screened case 174 to the PCB with suitable voltage clearance for 600 V. Filter output connections 3 and 4 pass straight through the side wall of the magnetron screened chamber 16 when the filter is externally mounted on a wall of the screened chamber 16. That is, connections 3 and 4 are mounted on a side wall of the screened chamber 16. The first and second output connections 3 and 4 pass through the ground plate with suitable clearance for the voltage rating provided by circular apertures 176 in the ground plane. The ground plane 173 is bonded on assembly to the magnetron compartment screen 16 to make electrical connection.

FIG. 4 shows an overall arrangement of the filter 17. The ground plane 173 is electrically connected to a top face perimeter of the upper layer of the PCB again with suitable clearance from the components for the voltage rating used. Connection of the ground plate to a perimeter of the opposed face of the PCB is provided by a plurality of plated through holes 177 or as an alternative by fully plating over the edge of the PCB. The spacing of the plated through holes is less than 0.05 of a wavelength to provide effective shielding. For 900 MHz a spacing of 1.0 cm suffices. The screened case 174 of the filter 17 is provided with an outward facing flange 1741 where the walls of the screen case meet the PCB to accommodate the plated through holes 177 and for fixing the filter 17 to the wall of the screened chamber 16 and making electrical connection thereto.

An advantage of the present invention is therefore that the step-down isolation transformer 14, as shown in Applicant's co-pending application GB 0919718.7, is moved into the magnetron enclosure 16, so that filtering can be carried out on lower currents than would be the case with filtering between the isolation transformer and magnetron, for example, the isolation transformer 14 (and rectifier) might have 240 volt at 6 amps on its input and 12 volt at 120 amps on its output. A suitable heater supply typically operates at 15 kHz but heater supplies with frequencies in the range 10 kHz to 500 kHz are known.

The filter 17 is positioned outside the magnetron enclosure 16. If it were within the screened chamber, although its output would be duly filtered, further stray radiation 23 could be picked up on the filtered output which would then be carried on the output leads through the screened magnetron chamber 16. Also, there are no electrical leads outside the magnetron enclosure leading to the filter, which could pick up stray radiation.

The filter minimizes stray capacitance on the inductances, and stray inductance on the capacitors, promoted by surface mounting.

The filter passes the heater supply current with a frequency of 15 kHz, which may be compared with a domestic cooker magnetron, in which the heater supply is at a frequency of only 50 Hz.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A low-pass filter arrangement for reducing stray emissions from a magnetron that is encased, along with an associated isolation transformer electrically connected to terminals of the magnetron, by an electrically conducting screen, the arrangement comprising: a low pass filter having an output connection; and an interface between the low pass filter and the electrically conducting screen, wherein the output connection of the low pass filter passes directly through the interface for electrical connection, directly or indirectly, with the isolation transformer, and the low pass filter is attached to an exterior face of a wall of the electrically conducting screen; the low pass filter further comprising a printed circuit board having first and second faces; wherein the interface comprises a ground plane arranged on the first face, at least one capacitor plate is arranged on the second face opposed to the ground plane on the first face, and the output connection of the low pass filter is connected directly or indirectly to the at least one capacitor plate.

2. The filter arrangement as claimed in claim 1, wherein the printed circuit board has a through-hole and the output connection passes via the through-hole in the printed circuit board directly to the at least one capacitor plate.

3. The filter arrangement as claimed in claim 1, wherein the ground plane includes an aperture for passage there through of the output connection, for voltage hold off between the output connection and the ground plane.

4. The filter arrangement as claimed in claim 1, wherein the low pass filter comprises a plurality of LC stages between a first line and the ground plane and between a second line and the ground plane.

5. The filter arrangement as claimed in claim 4, wherein inductors in neighbouring LC stages are orthogonal to each other to minimize coupling between the inductors.

6. The filter arrangement as claimed in claim 4, wherein the capacitors of the plurality of LC stages include capacitor plates that have dimensions of substantially 22 mm by 22 mm.

7. The filter arrangement as claimed in claim 1, further comprising an electrically conducting screen encasing the low pass filter and arranged for electrical connection to the electrically conducting screen of the magnetron.

8. The filter arrangement as claimed in claim 7, wherein the interface comprises a ground plane that is electrically connected to the electrically conducting screen of the low pass filter.

9. The filter arrangement as claimed in claim 1, wherein the low pass filter is arranged to filter stray radiation with frequencies in a range 100 MHz to 1 GHz.

10. The filter arrangement as claimed in claim 1, wherein the low pass filter is arranged to filter stray radiation with frequencies in a range 100 MHz to 2 GHz.

11. The filter arrangement as claimed in claim 1, wherein the low pass filter is arranged for a magnetron producing an output at a frequency of substantially 900 MHz.

12. A method for reducing stray emissions from a magnetron, comprising:

using a low-pass filter comprising a printed circuit board having first and second faces attached to an exterior face of a wall of an electrically conducting screen encasing the magnetron and encasing an associated isolation transformer electrically connected to terminals of the magnetron, the second face of the printed circuit board having at least one capacitor plate arranged thereon; and passing an output connection of the low pass filter, connected directly or indirectly to the at least one capacitor plate, directly through an interface, attached to the first face of the printed circuit board and arranged between the electrically conducting screen and the first face of the filter printed circuit board to connect electrically, directly or indirectly, with the isolation transformer.

13. A low-pass filter arrangement for reducing stray emissions from a magnetron that is encased, along with an associated isolation transformer electrically connected to terminals of the magnetron, by an electrically conducting screen, the arrangement comprising:

a low pass filter having an output connection; and an interface between the low pass filter and the electrically conducting screen;

wherein the output connection of the low pass filter passes directly through the interface for electrical connection, directly or indirectly, with the isolation transformer, and the low pass filter is attached to an exterior face of a wall of the electrically conducting screen;

wherein the low pass filter further comprises a printed circuit board having first and second faces, wherein the interface comprises a ground plane arranged on the first face, wherein at least one capacitor plate is arranged on the second face opposed to the ground plane on the first face, and the output connection of the low pass filter is connected directly or indirectly to the at least one capacitor plate, and wherein the low pass filter comprises a plurality of LC stages between a first line and the ground plane and between a second line and the ground plane; and wherein the low pass filter further includes a first capacitor and a first resistor in series between the first line and the ground plane and a second capacitor and a second resistor connected in series between the second line and the ground plane to ensure nominally matched impedance at frequencies of the stray emissions thereby minimizing gain of the low pass filter at frequencies in a desired attenuation band while providing insignificant impedance to a waveform output from a heater supply inverter.

* * * * *